US007677860B2

(12) United States Patent
Kivistö et al.

(10) Patent No.: US 7,677,860 B2
(45) Date of Patent: Mar. 16, 2010

(54) METHOD AND APPARATUS FOR TRANSFERRING SHEET-LIKE OBJECTS

(75) Inventors: Tuomo Kivistö, Jorvas (FI); Tom Marttila, Espoo (FI)

(73) Assignee: Outotec Oyj, Espoo (FI)

( * ) Notice: Subject to any disclaimer, the term of this patent is extended or adjusted under 35 U.S.C. 154(b) by 433 days.

(21) Appl. No.: 10/497,737

(22) PCT Filed: Nov. 29, 2002

(86) PCT No.: PCT/FI02/00962

§ 371 (c)(1),
(2), (4) Date: Jun. 4, 2004

(87) PCT Pub. No.: WO03/053839

PCT Pub. Date: Jul. 3, 2003

(65) Prior Publication Data

US 2005/0036872 A1 Feb. 17, 2005

(30) Foreign Application Priority Data

Dec. 5, 2001 (FI) ..... 20012391

(51) Int. Cl.
*B66C 13/08* (2006.01)

(52) U.S. Cl. ..... 414/626; 414/806

(58) Field of Classification Search ..... 414/560, 414/626, 806

See application file for complete search history.

(56) References Cited

U.S. PATENT DOCUMENTS 5,151,006 A * 9/1992 Marttila et al. ..... 414/626
6,174,123 B1 1/2001 Marttila ..... 414/626
6,379,104 B1 * 4/2002 Domino et al. ..... 414/662

FOREIGN PATENT DOCUMENTS

JP 8013180 1/1996

* cited by examiner

*Primary Examiner*—Charles A Fox
(74) *Attorney, Agent, or Firm*—Brandon T. Schurter; Locke Lord Bissell & Liddell LLP

(57) ABSTRACT

The invention relates to a method for transferring heavy loads, such as sheet-like objects, particularly anodes and cathodes, in electrolysis, the transfer apparatus comprising a lifting device (1) to which a stationary control housing (3) is attached; along the slide surfaces (6) of said control housing (3), there moves a control frame (5), and in said control frame there are arranged control shafts (7) along which a gripping element (8) is movable by the control surfaces (16) of said gripping element (8), so that the stationary control housing (3) is suspended from the lifting device (1) by means of at least three fastening elements (2) articulated at both ends. In addition, the invention relates to a transfer apparatus (4) for shifting heavy loads, particularly sheet-like objects, such as anodes and cathodes in electrolysis, said transfer apparatus comprising a control housing (3) attached to a lifting device (1), to which control housing there is attached to a control frame (5) movable along the slide surfaces (6) of the control housing (3), and in which control frame there are arranged control shafts (7) along which a gripping element (8) is movable by means of the control surfaces (16) of said gripping element, so that the control housing (3) is suspended from the lifting device (1) by at least three fastening elements (2) articulated at both ends.

6 Claims, 2 Drawing Sheets

METHOD AND APPARATUS FOR TRANSFERRING SHEET-LIKE OBJECTS

FIELD OF THE INVENTION

The invention relates to a method for transferring heavy loads, such as sheet-like objects, particularly anodes and cathodes in electrolysis, as well as an apparatus for realizing said transfer.

BACKGROUND OF THE INVENTION

Electrolytic cleaning processes use large amounts of anodes and cathodes for precipitating and decomposing metals. In these processes, sheet-like electrodes, anodes and cathodes, should be for instance transferred into electrolysis tanks and out thereof. In the tanks, the anode and cathode should be placed as near to each other as possible. When electrodes must be replaced for example in order to recover a precipitate created on a cathode, the replacement is carried out by means of a batching element that first removes from the tank a desired number of electrodes, such as cathodes, and replaces them by an equal number of unprecipitated starting sheets. Nowadays electrode transport and their batching into tanks takes place by means of a tool, a spear, hanging from the hooks of a lifting device. It has been observed that the lowering of electrodes into tanks is difficult and requires, from time to time, manual guiding of the spear on the tank level. The electrodes to be lowered in the tanks easily collide against those already placed therein, because the intervals are short and irregular owing to the manual work. Collisions cause defects particularly in the starting sheets, and as a result short circuits are increased during electrolysis. Consequently, in order to avoid short circuits, the batching element and particularly the grip provided in the batching element must be set in an advantageous position with respect to the electrodes in order to prevent any contact between the separate electrodes. Among the drawbacks of the manual method, let us point out that it is slow and has a poor level of accuracy, and that the physical work is hard and dangerous. Among the drawbacks of the traditional methods, let us also point out that the gripping element swings during acceleration and slow-down, so that a precise alignment of the gripping element becomes difficult.

From the publication DE 3,508,195 there is known an apparatus where the target of alignment is provided with mechanical guide cones that perform an accurate alignment as the gripping device is lowered down. The movement of accurate alignment takes place on sliding and rolling surfaces that also support the load and the gripping member.

From the publication FI 870,285 there is known a device where the loading member is provided with a stationary guide, along which a separate housing moves supported by the loading arrangement. A gripping device is suspended from this housing by fastening elements, and the gripping device is shifted with respect to the housing in order to achieve an accurate alignment.

BACKGROUND OF THE INVENTION

The object of the invention is to alleviate the drawbacks of the prior art and to introduce a novel apparatus and method for transferring heavy loads, such as sheet-like objects, particularly anodes and cathodes in electrolysis.

DETAILED DESCRIPTION OF THE INVENTION

Figure 1:
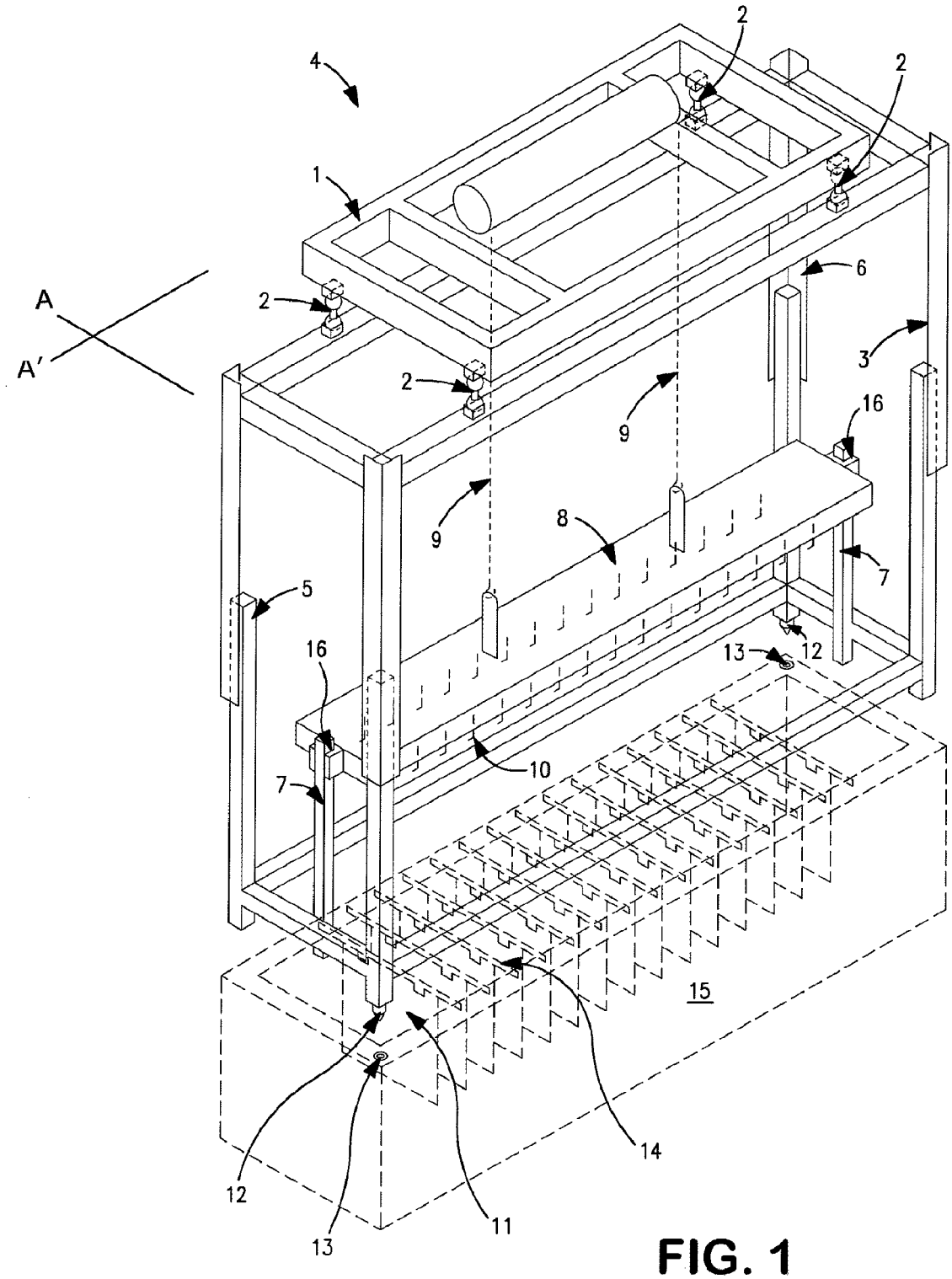
FIG. 1 Transfer apparatus
Figure 2:
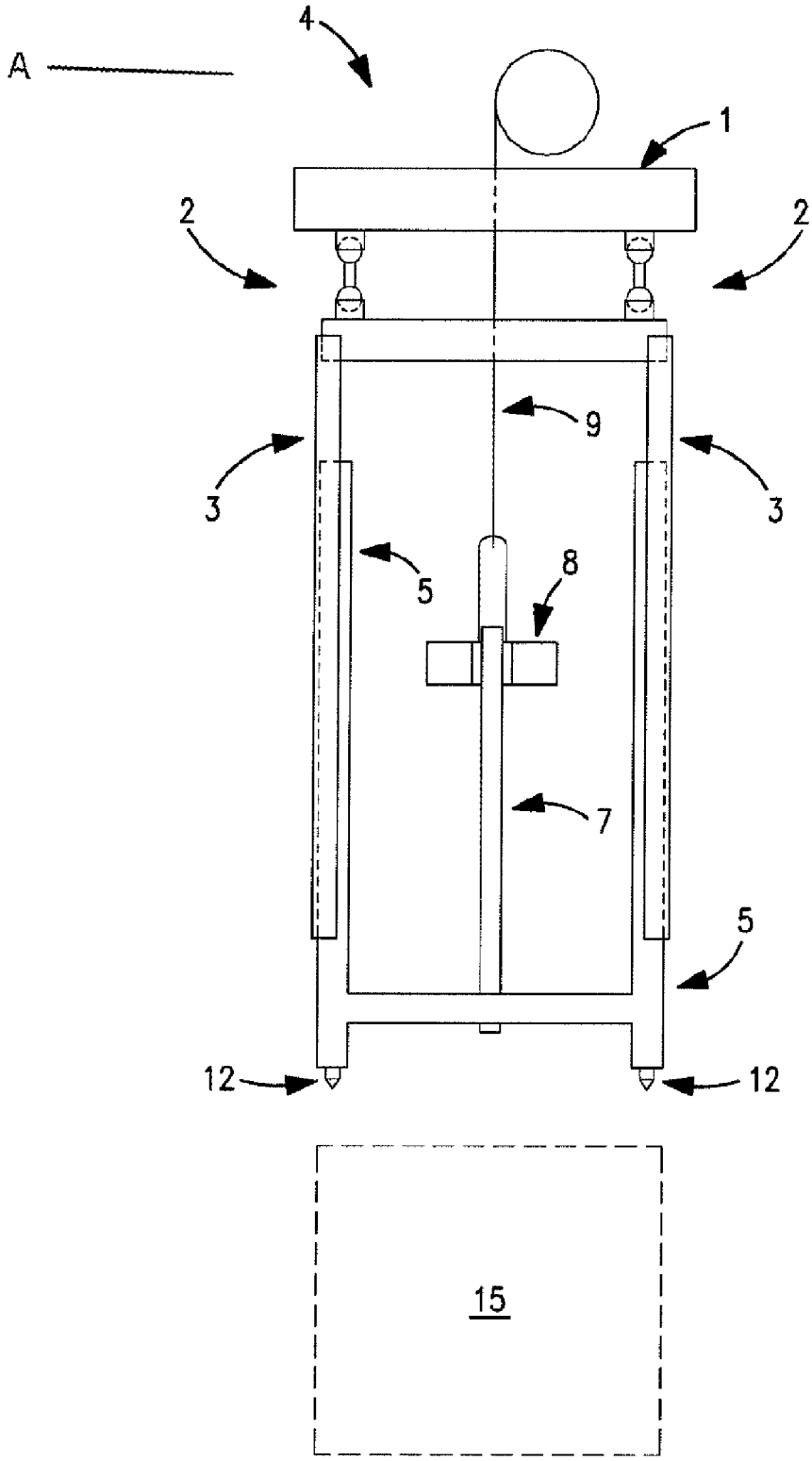
FIG. 2 Transfer Apparatus profile, viewed from the perspective along the A' axis.

According to the invention, excessive and harmful swinging movements of the transferring apparatus of sheet-like objects are advantageously prevented when aligning said apparatus and the load transferred by said apparatus at the right spot by the tanks. The transfer apparatus comprises a lifting device and a stationary control housing attached thereto, said control housing being fastened to the lifting device by at least three fastening elements that are articulated at both ends. Along the slide surfaces of the stationary control housing, there is arranged an essentially vertically movable control frame. A gripping device belonging to the transfer apparatus moves along the vertical control shafts of the control frame by means of the control surfaces of the gripping device. From above, the gripping device is suspended from the lifting device by means of ropes. The gripping device is movable essentially in the vertical direction both with respect to the stationary control housing and to the movable control frame.

Underneath the gripping device, there are provided gripping elements such as hooks that grip the sheet-like objects at corresponding spots when the objects, such as electrodes, should be moved. Owing to its articulated fastening elements, the control housing of the apparatus can be horizontally shifted and rotated with respect to the lifting device. When the control frame is lowered down in the tank, the conical pins arranged in at least two corners of the frame are inserted in the holes provided in the tank in order to prevent the load from swinging during the lifting or lowering of the load. Respectively it is possible that the conical pins are arranged in the tank, and that the corners of the control frame are provided with holes for the pins.

According to the invention, the control frame is attached, by at least three fastening elements such as rigging screws that are articulated at both ends, to the lifting device. Now, preferably by using the structure according to the invention, the control frame attenuates the mass inertial forces in the horizontal acceleration and slow-down of the load. By observing the length of the fastening element and the swinging angle thereof, the swinging of the load of the transfer apparatus can be controlled. The fastening elements must be sufficiently short, preferably 200-500 mm, and the swinging angle of the fastening elements is essentially larger than six degrees, in which case it advantageously tends to return back to the vertical position during horizontal acceleration and slow-down. When the angle is set right, the shift of the whole apparatus in all directions is preferably restricted to +/−50 millimeters, and the alignment is advantageously successful with these limit values. The conical pins are made to fit into the holes designed for them. In addition, by making the contacting surfaces of the slide surfaces and the control frame as free of clearance as possible, the load is further prevented from swinging. Moreover, by adding in the control frame an arrangement for locking the frame in its position for the duration of lifting or lowering, more stability is achieved in a lifting and lowering situation. By employing the transfer apparatus according to the invention, there also is achieved the advantage that manual help is not necessarily needed when setting the gripping device at the right spot at the tanks.

The transfer apparatus is controlled by a computer at the right spot at the tanks, and visible swinging does not occur.

The invention is described in more detail below with reference the appended drawing.

In a lifting device 1 according to FIG. 1, there is suspended by rigging screws 2 a stationary control housing 3. The rigging screws 2 are preferably short, with a length of 250 millimeters. Now, when using the structure according to the invention, the control housing 3 advantageously attenuates the mass inertial forces during horizontal acceleration and slow-down of the load. Thus, when the lifting device 1 moves from tank to tank, the horizontal swinging of the load is prevented. The transfer apparatus 4 is shifted to the desired, spot by computer control. When necessary, the stationary control housing 3 can be moved horizontally and turned around its central axis by means of the ball joints provided at both ends of the rigging screws. The movable control frame 5 belonging to the transfer apparatus 4 is arranged to move essentially vertically along the slide surfaces 6 of the control frame. The control frame 5 is provided with vertical control shafts 7, along which a gripping element 8, such as a spear, can be moved in the vertical direction by means of the control surfaces 16 of the spear. The control shafts 7 are arranged vertically on the opposite sides of the control frame 5, and they are square in cross-section. Advantageously the control shafts are placed so that during the lifting of the control frame 5, they do not strike the lifting device 1 located above. From above, the spear 8 hangs from the lifting device and is attached thereto by ropes 9. Underneath the spear 8, there are provided gripping elements 10 such as hooks, whereby the electrodes 11 are lifted from the tank or lowered therein.

When the transfer apparatus 4 should be aligned at the right spot at the tank 15, the location is first programmed by using a computer. When the apparatus is aligned at the right spot. the control frame 5 moving along the slide surfaces 6 of the control housing 3 is mechanically lowered down, and at the tanks the conical pins 12 provided at least at two corners of the control frame are inserted in the holes 13 meant for the conical pins, while the rigging screws 2 allow the necessary horizontal and turning motion of the control housing 3 with respect to the lifting arrangement. In shape, the holes are either round or elongate, and their diameter is preferably 100 millimeters. Advantageously the holes can be manufactured already when the tank is being made. Thereafter a gripping element 8, such as a spear, is lowered down by means of wires, so that it slides supported by the control shafts of the control frame. The hooks provided in the spear are fastened to brackets 14 provided in the electrodes 11, and the electrodes are lifted to a suitable height. Thereafter the control frame is lifted up, and the lifting device 1 transfers the electrodes 11 to the desired position.

The invention claimed is:

1. A method for transferring loads comprising:

a) positioning a transfer apparatus over a tank, wherein said transfer apparatus comprises:

a lifting device;

a control housing having essentially vertical members with slide surfaces attached to the lifting device from the uppermost part of the control housing by means of at least three fastening elements, the fastening elements each have a length of between 200-500 millimeters and are articulated at both ends;

a control frame having essentially vertical members corresponding to the essentially vertical members of the control housing attached to the control housing and movable along the slide surfaces of the control housing; wherein each vertical member of the control frame contacts each corresponding vertical member of the control housing on at least two surfaces;

at least one control shaft attached to the control frame; and a gripping element suspended by means of a moving element from the lifting device, wherein the gripping element is movable along the control surfaces of the control shaft;

b) attaching sheet-like objects to the gripping element; and c) transferring a load of the sheet-like objects.

2. The method according to claim 1, wherein at least two conical pins are in at least two corners of the control frame and each conical pin can be inserted in holes in the corners of the tank.

3. The method according to claim 1 wherein at least two conical pins are in at least two corners of the tank and each conical pin can be inserted in holes in the corners of the control frame.

4. A transfer apparatus for transferring loads comprising:

a lifting device;

a control housing having essentially vertical members with slide surfaces attached to the lifting device from the uppermost part of the control housing by means of at least three fastening elements, the fastening elements each have a length of between 200-500 millimeters and are articulated at both ends;

a control frame having essentially vertical members corresponding to the essentially vertical members of the control housing attached to the control housing and movable along the slide surfaces of the control housing; wherein each vertical member of the control frame contacts each corresponding vertical member of the control housing on at least two surfaces;

at least one control shaft attached to the control frame; and a gripping element suspended by means of a moving element from the lifting device, wherein the gripping element is movable along the control surfaces of the control shaft.

5. The transfer apparatus according to claim 4, wherein at least two conical pins are in at least two corners of the control frame, and each conical pin can be inserted in holes at the corners of the tank.

6. The transfer apparatus according to claim 4, wherein at least two conical pins are in at least two corners of the tank and each conical pin can be inserted in holes at the corners of the control frame.

* * * * *